United States Patent [19]

Robinson et al.

[11] Patent Number: 4,993,844

[45] Date of Patent: Feb. 19, 1991

[54] COMPARTMENTED DOUBLE ZIPPER POUCH

[75] Inventors: John P. Robinson, Clifton; William R. Stadick, North Brunswick; Thomas L. Clawges, Spotswood; Thomas P. Minogue, Clifton, all of N.J.

[73] Assignee: LPS Industries, Inc., Newark, N.J.

[21] Appl. No.: 443,480

[22] Filed: Nov. 30, 1989

[51] Int. Cl.[5] ..... B65D 30/22

[52] U.S. Cl. ..... 383/38; 383/63

[58] Field of Search ..... 383/38, 40, 63, 65; 229/74

[56] References Cited

U.S. PATENT DOCUMENTS

| | | | |
|---|---|---|---|
| 503,858 | 8/1893 | Katzer | 383/38 |
| 1,211,025 | 1/1917 | Wright | 383/38 |
| 1,671,977 | 6/1928 | Brown | 383/38 |
| 1,724,799 | 8/1929 | Jensen | 383/38 |
| 2,654,527 | 10/1953 | Geckler et al. | 383/40 |
| 2,916,197 | 12/1959 | Detric et al. | 383/63 |
| 4,756,628 | 7/1988 | Branson | 383/38 |

*Primary Examiner*—Stephen P. Garbe

*Attorney, Agent, or Firm*—Fitzpatrick Cella Harper Scinto

[57] ABSTRACT

A double zipper pouch having first and second pockets adjacent one another and with a common wall portion, each pocket having an opening for receiving contents such as identification papers. The first and second pockets are formed so that their openings are displaced relative to one another. Pressure actuated resealable fasteners are disposed adjacent the openings in each of the first and second pockets. First and second indicators are also disposed adjacent the openings to provide an indication of the location of the associated opening. The indicators are preferably different from one another so as to provide an identification for the associated pocket. An adhesive material is formed on the back of the first pocket for affixing the pouch to, for example, a package.

6 Claims, 5 Drawing Sheets

Fig. 4.
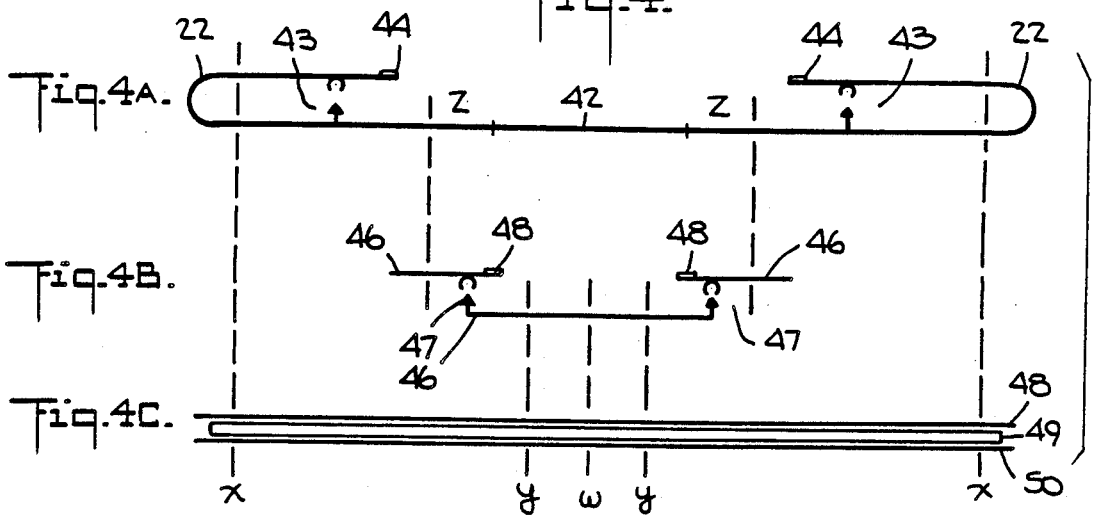
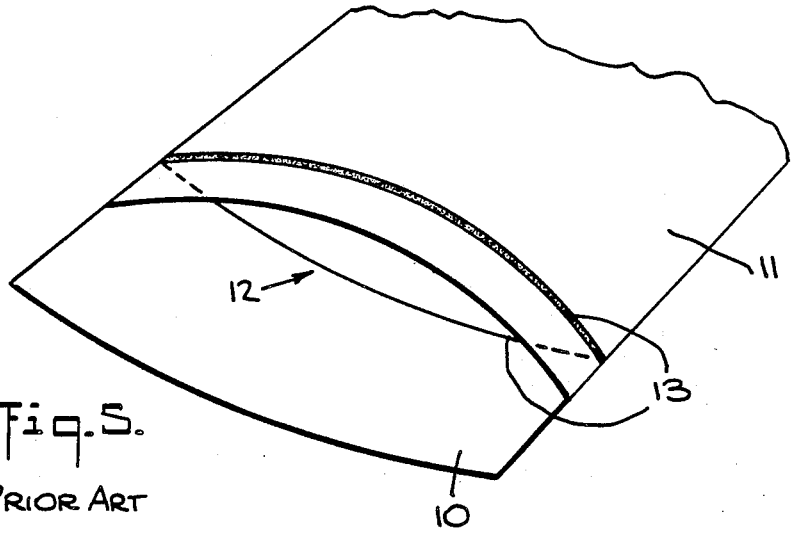
Fig. 5.
PRIOR ART
Fig. 6.
PRIOR ART
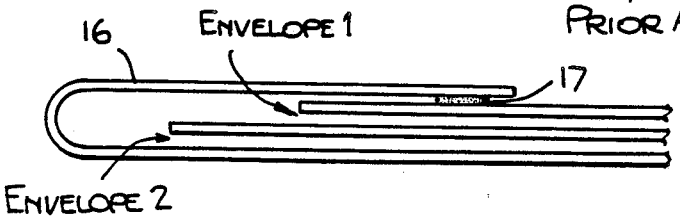

COMPARTMENTED DOUBLE ZIPPER POUCH

BACKGROUND OF INVENTION

1. Field of the Invention

The present invention pertains to a pouch having two co-extensive resealable pockets. The pouch is designed to be affixed through adhesive means to another article, and the pockets are intended to receive papers and other items associated with the other article. In a particular application, the pouch is affixed to the outside of a package being shipped (domestic or overseas), and is used to receive identification documents such as airbill and customs documents.

2. Description of the Related Art

The invention will be described with reference to its use in the business of shipment of packages (locally, nationally or internationally).

In this business, it is necessary to affix to the package a number of identifying documents. The documents are of different types, such as airbill documents, customs documents and billing documents. The documents must be kept together with the package yet must be readily and individually accessible. It is further desired that the documents be separated into the different types of documents so as to avoid confusion and mistake.

A single-envelope shipping pouch for such a purpose is known and is illustrated generally in FIG. 5. As shown in FIG. 5, the single-envelope pouch consists of a base sheet 10 on which is mounted a second additional sheet 11, thereby forming a pocket 12. At the opening of the pocket the edges of the sheets 10 and 11 are displaced with respect to each other to permit a resealable closure device 13 to be attached to the edges of sheets 10 and 11. On the back surface of the base sheet 10 an adhesive material (not shown) is applied so as to permit the pouch to be affixed to a shipping package, and a removable backing sheet is provided to protect the adhesive.

In use, the single-envelope pouch is affixed to the package through the adhesive material on the back of base sheet 10. Documents are inserted into the envelope 12 and the resealable closure 13 is sealed.

A problem arises however, when several types of documents must be kept separately.

Double envelope pouches have also been known in the past, but such double envelopes did not include closures or backing adhesive.

It has been proposed to provide such a double envelope pouch with a adhesively sealable closure flap in the manner shown in FIG. 6, and in that configuration documents could be separately stored and affixed to a shipping package. However, certain disadvantages exist with respect to that proposal. For example, in the proposed envelope of FIG. 6 the closure flap 16 is provided with an adhesive strip 17 for closing the two envelopes. However, when the flap 16 is folded over pockets 1 and 2 and secured in position by adhesive strip 17, it will be seen that the pouch is reliably used only once. That is, as noted above, an adhesive material is used to seal both envelopes. When the seal is broken by lifting flap 16, the adhesive material 17 will deform the material of the outer envelope (envelope 1). In many instances, the adhesive material is strong enough to tear the envelope itself. Since the torn material remains on the adhesive strip, not only is the pouch damaged, but the efficiency of adhesive strip 17 is also lowered. This problem takes on special significance when it is considered that the pouch must be opened and closed on several occasions, e.g. at custom checkpoints. Thus, resealing the pouch becomes a chancy prospect at best.

Further, when adhesive strip 17 is exposed in preparation for sealing the pouch, the adhesive strip will stick to anything that comes in contact with it. This is especially inconvenient since it may stick to the documents that are to be inserted into the envelope.

Moreover, it will be appreciated that since only a single flap is provided, opening the pouch opens both envelopes at once. Thus, for example, even though access only to envelope 2 is desired, both of envelopes 1 and 2 must be opened. This, of course, exposes the documents inside these envelopes to the risk of loss, and permits the introduction of undesired documents into the pockets.

A further disadvantage of the proposed two-envelope system is the need to distinguish between the two envelopes. Although the two envelopes are displaced with respect to one another, it is still hard to distinguish where one opening begins and the other opening ends. Thus, a document may be inserted into the wrong envelope. This is especially disadvantageous in the instance when, for example, the upper envelope should be used solely for customs documents and the lower envelope solely for shipping information. It will be seen that confusion between these two types of documents will significantly delay delivery of the package.

SUMMARY

It is therefore an object of the present invention to avoid these and other difficulties found in the prior art.

It is a further object of the present invention to provide a pouch having multiple and resealable pockets that can be used repeatedly without causing damage to the pouch.

It is a further object of the present invention to provide a pouch with multiple pockets which are clearly identifiable so that they may be distinguished from one another and permit positive placement of appropriate documents in each pocket.

It is a further object of the present invention to provide a pouch having multiple resealable pockets which individually seal each pocket to prevent the contents of the pockets from accidentally being lost.

It is a further object of the present invention to provide a method and apparatus for the efficient manufacture of such pouch.

These and other objects of the present invention are obtained by the provision of a pouch having first and second pockets adjacent one another and with a common wall portion, each pocket having an opening for receiving contents such as identification papers. The first and second pockets are formed so that their openings are displaced relative to one another. Pressure actuated resealable fasteners are disposed adjacent the openings in each of the first and second pockets. First and second indicators are also disposed adjacent the openings to provide an indication of the location of the associated opening. The indicators are preferably different from one another so as to provide an identification for the associated pocket. An adhesive material is formed on the back of the first pocket for affixing the pouch to, for example, a package.

BRIEF DESCRIPTION OF THE DRAWINGS

FIG. 4 is a schematic cross-sectional view used to explain the manufacturing process of the apparatus of FIG. 3;

FIG. 5 is a view of a prior art pouch; and

FIG. 6 is a view of a proposed double envelope pouch.

DETAILED DESCRIPTION OF THE INVENTION

Figure 1:
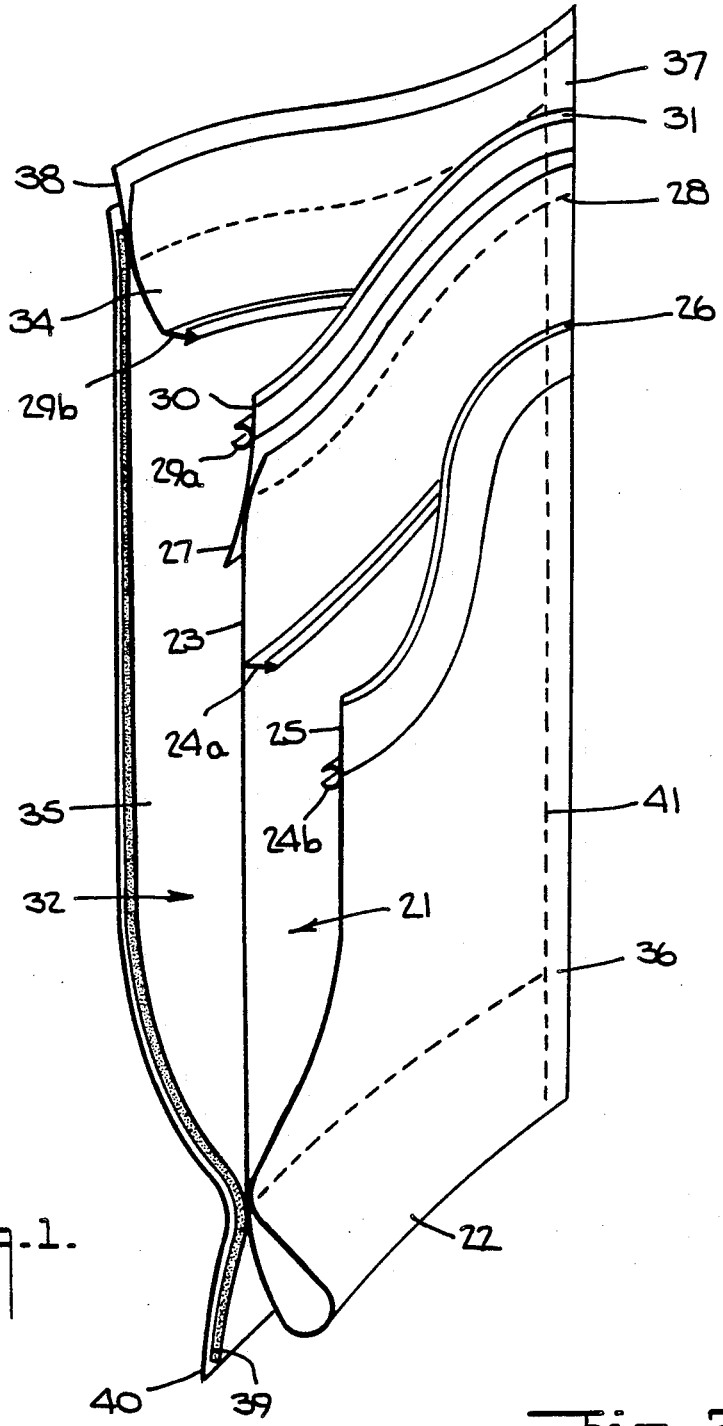
FIG. 1 is a partially cut away prospective view of an embodiment of the invention.
Figure 2:
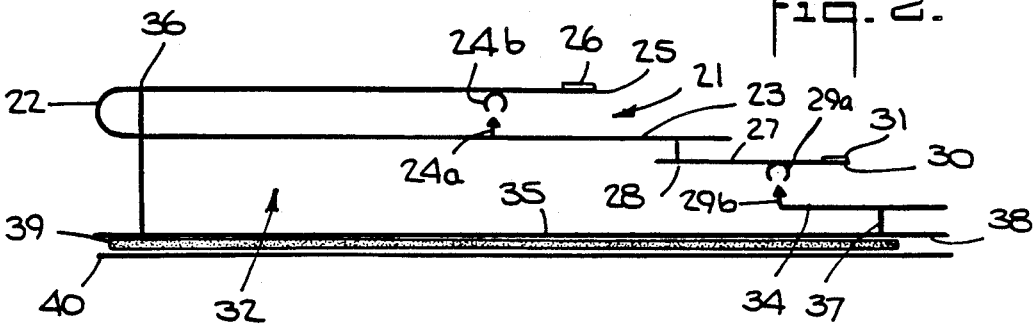
FIG. 2 is schematic cross-sectional view of the embodiment of FIG. 1.

The invention will now be explained with reference to the partially cut-away perspective view shown in FIG. 1, and the cross-sectional view shown in FIG. 2.

As shown in these figures, a first pocket 21 is formed from a folded over sheet 22 of extruded plastic such as polyethylene or other plastic suitable for use as a pocket. It will be seen in the figures that one leg of the extruded sheet is extended to form a flange 23. The use of a folded over sheet is, of course, merely by way of example, and individual sheets may be substituted therefor.

Across the open end of the extruded sheet 22, a pair of complementary interlockable and separable rib and groove type fasteners 24*a* and 24*b* are disposed so as to provide a reopenable seal for pocket 21. As shown in these drawings, the fasteners are depicted as a single arrow-shaped rib engageable with a single groove-shaped profile. Of course, any of the several known complementary shaped interlocking fasteners or zippers can be used.

At the free end 25 of first pocket 21, a visual indicator 26 is disposed so as to identify the position of the opening in the first pocket. In the preferred embodiment, the indicator is a colored strip disposed adjacent the opening. As will be seen, different colors are used for different pockets to provide an immediately perceivable indication for discriminating between the two pockets, both as to location and as to identification of the intended contents of the pocket. Of course, any indicator, including the mounting for the fastener itself, may be used as the indicator to identify the position of the opening in the pocket. On the opposite side of pocket 21, the upper end of flange 23 is welded along dotted line 28 to a strip 27 of appropriate plastic material. The strip 27 carries one half 29*a* of another set of complementary interlocking fasteners. The upper end 30 of strip 27 carries a second visual indication 31 signifying the position of the opening in second pocket 32. As before, the indicator may be a colored strip and preferably is chosen of a different color than that of strip 26. The other half 29*b* of the complementary interlocking strip is mounted on a second strip 34 of appropriate plastic material.

Backing sheet 35 of appropriate plastic material is disposed adjacent extruded sheets 21 and 22 and strip 34 and is welded along dotted lines 36 and 37 to form the second pocket 32.

Welds are also formed at the side surfaces of the pouch to complete the pockets and to ensure that the interlocking fasteners do not become separated. One of these welds, 41, is shown in FIG. 1.

If desired, backing sheet 35 conveniently is provided with an adhesive layer 39 on the rear surface thereof. The adhesive layer is protected until use by a paper backing 40 which may be removed to permit the pouch to be affixed to the package. As shown in FIGS. 1 and 2, and adhesive layer does not extend completely to the top of the pouch which is left free of adhesive. This free are 38 provides a convenient tab which may be grasped to open second pocket 32 when the pouch is affixed to the package.

In use, backing sheet 40 is peeled from the pouch to expose adhesive layer 39, and the pouch is adhered to the package. A selected one of the two pockets 21 and 32 is located using indicators 26 and 31, and the selected pocket is opened. If, for example, first pocket 21 is selected, the pocket is opened by grasping and pulling upper end 25, thereby to disengage interlocking fastener 24 (a and b). If, on the other hand, second pocket 32 is selected, the pocket is opened by grasping and pulling upper end 30 thereby to disengage interlocking fastener 29 (a and b). Documents appropriate for the selected pocket are inserted, and the fastener is resealed.

Figure 3:
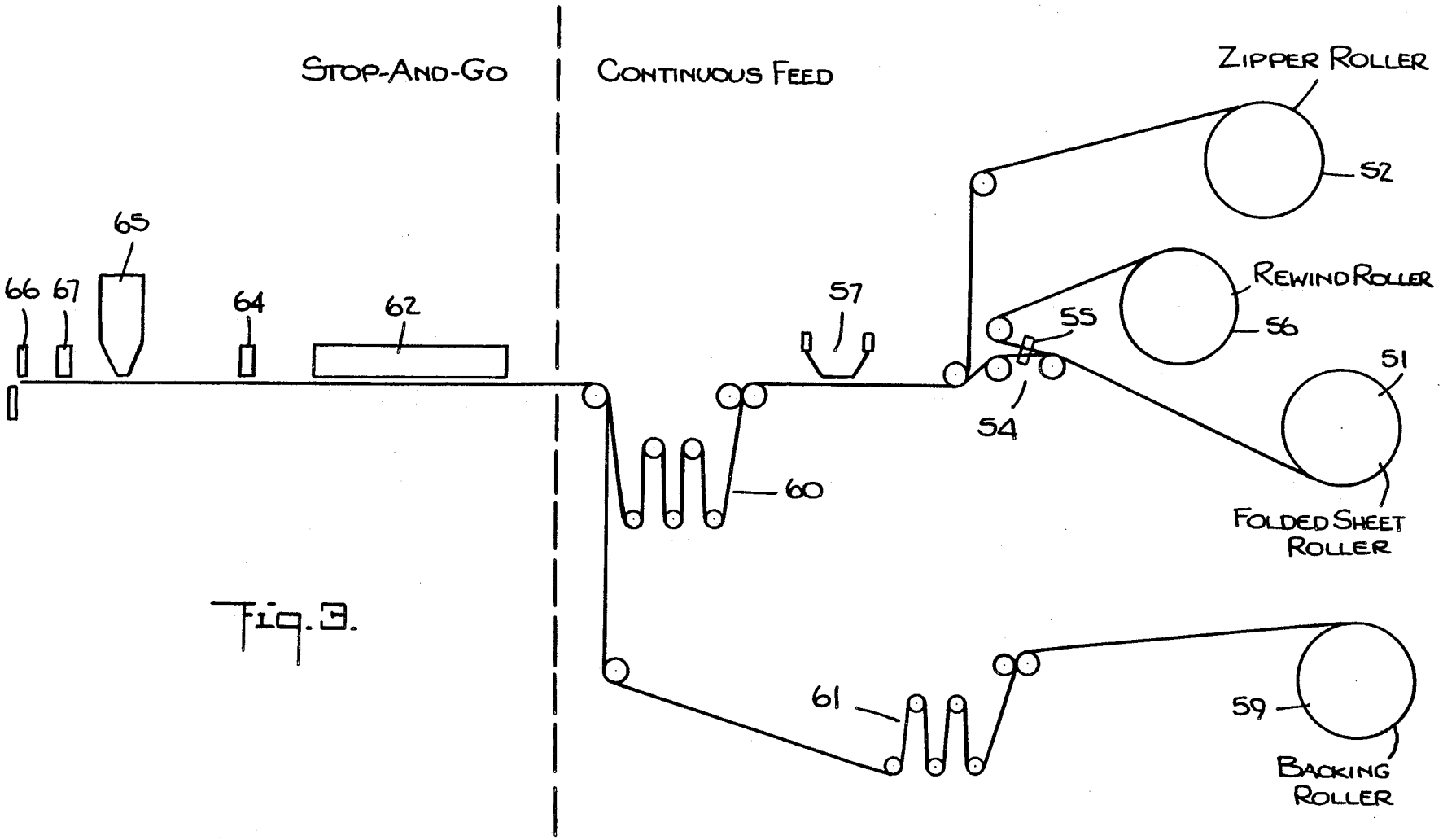
FIG. 3 is a schematic diagram of an apparatus useful in manufacturing pouches according to the invention.

FIG. 3 schematically depicts an apparatus particularly suitable for the production of such a pouch. The apparatus is especially efficient because it produces two such pouches at one time in an end-to-end fashion.

As shown in FIG. 3, the apparatus is divided into two sections, a continuous feed section and a stop-and-go section. In the continuous feed section, the apparatus includes a roller 51 for holding an end-to-end mounted extruded folded sheet such as that shown in FIG. 4A. With reference to FIG. 4A, it will be seen that the extruded sheet consists of a pair of folded portions such as that shown at 22 in FIG. 1 mounted end-to-end with an elongated flange 42 therebetween. As will be seen below, the elongated flange permits a larger spacing to be maintained between the folded portions.

As further shown in FIG. 4A, the end-to-end mounted extruded sheet includes a pre-mounted pair of complementary interlocking fasteners 43 and a pre-mounted indicator 44.

Returning to FIG. 3, the apparatus further comprises a zipper roller 52 which carries a three-sheet construction of plastic strips having pre-mounted interlocking fasteners and color indicators mounted thereon. Such a construction is shown schematically in FIG. 4B. As seen there, three plastic strips 46 are arranged with a pair of interlocking zippers 47 and indicators 48 mounted thereon.

Returning to FIG. 3, a first station 54 includes a cutter 55 for removing extended flange 42 from the extruded folded sheet. A rewind roller 56 is provided for rewinding waste material that is so removed from the extruded folded sheet.

Sealing means 57, for example hot wires, are provided downstream of the first station to weld the fasteners at "Z" in FIG. 4.

A backing roller 59 is provided to carry backing material such as that shown in FIG. 4C. As shown there, the backing material includes a plastic surface 48 having an adhesive 49 mounted on the rear surface thereof. The adhesive is protected from contamination by backing paper 50.

A pair of dancer rollers 60 and 61 are provided downstream of the first station and of the backing roller. The dancer rollers allow synchronization between the feeding speeds of material provided from the first station 54, the backing roller 59 and the zipper roller 52. The dancer rollers also permit coordination between the continuous feed section in the right-hand side of FIG. 3 to the stop-and-go section in the left-hand side of FIG. 3.

In the stop-and-go section, a set of four longitudinal sealing hot rods 62 (one shown) are positioned so as to provide the top and bottom welds such as those shown at "x" and "y" in FIG. 4. Downstream of the longitudinal sealing rods, a sonic welder or crusher 64 is provided to crush the interlocking fasteners to prevent separation thereof. Finally, a cross sealing hot rod 65 is provided to weld the side surface of the pouch as shown, for example, at 41 in FIG. 1. Station 67 operates to perforate or separate the end-to-end pouches longitudinally, and a knife cutter 66 is provided to separate the individual pouches laterally.

In operation, the end-to-end extruded sheet is fed from roller 51 to first station 54. Simultaneously, the three-sheet zipper construction is fed from zipper roller 52 to the first station. Cutter 55 removes the extended flange 42 from the end-to-end sheet. The waste material is rewound onto rewind roller 56.

At first station 54, the end-to-end extruded sheet is aligned with the three-sheet zipper construction, as shown schematically in FIGS. 4A and 4B. Then, using sealing means 57, the end-to-end extruded sheet is welded to the zipper construction at the welding points "z" indicated in FIGS. 4A and 4B. The extruded sheet with the zipper strips attached thereto then is fed over dancer 60 to the stop-and-go section.

Meanwhile, backing material is fed from backing roller 59 to dancers 61 into the stop-and-go section.

In the stop-and-go section, a length of material corresponding to the width of a pouch is fed into the longitudinal sealing rods 62. The longitudinal sealing rods 62 are operated to form welds as indicated at "X" and "Y" in FIG. 4. (Since extended flange 42 has already been removed, it will be seen that weld "Y" can be formed without interfering with access to the second pocket.) Thus, the top and bottom welds for each bag are formed.

As the next length of sheet corresponding to the width of the pouches is fed to the longitudinal sealing rods, sonic welder or crusher 64 operates to crush the interlocking fastener to reduce its thickness and to prevent its separation. Meanwhile, cross sealing rod 65 welds the side weld for each bag. It will be appreciated that the relative spacing of the cross sealing rod 65, the sonic welder or crusher 64 and the longitudinal sealing rods 62 is such as to correspond to the width of a finished pouch.

Station 67 is operated to separate or perforate the end-to-end pouches longitudinally at "w". Finally, knife edge 66 is operated to separate the pouches laterally.

From the foregoing description, it will be appreciated that the purpose of the extended flange 42 in the extruded end-to-end folded sheet is to ensure adequate separation between the bags so as to permit insertion of the zipper construction from zipper roller 52, and to permit the formation of weld "Y" without, interfering with access to the second pocket. If the extended flange 42 is not provided, then other means must be provided to separate the end-to-end extruded tubing and to facilitate the formation of weld "Y". For example, instead of making two cuts to remove an extended flange from the extruded sheet, a single cut may be made and the extruded sheet separated at a later step. Of course, such an operation is more complicated and requires more careful alignment between the separated folded sheets and the zipper construction. As such, it less practicable for high-speed, high-volume production.

A preferred embodiment of the invention has been described so that the details of the invention may clearly be understood by those skilled in the art. However, the scope of the invention should not be measured by reference to the described embodiment, but instead by reference to the following claims.

What is claimed is:

1. A resealable pouch comprising first and second pockets adjacent one another and being formed with a common wall portion, each said first and second pocket having an opening for receiving selected contents, the openings being displaced relative to one another;

pressure actuated resealable fasteners disposed adjacent the openings in each of said first and second pockets; and a first indicator disposed adjacent the opening in said first pocket and a second indicator disposed adjacent the opening in said second pocket, said first and second indicators providing an indication of the location of their associated openings.

2. A resealable pouch according to claim 1, further comprising an adhesive material on the outside of one of said first and second pockets.

3. A resealable pouch according to claim 1, wherein said first and second indicators are different from each other so as to provide an identification for their associated pockets.

4. A resealable pouch according to claim 3, wherein said first and second indicators comprise colored strips.

5. A resealable pouch according to claim 1, wherein said first pocket comprises a folded sheet, and said second pocket comprises a sheet material affixed to said folded sheet, said common wall being formed by one leg of said folded sheet.

6. A resealable pouch comprising a sheet folded so as to form a first pocket having a depending flange and an open end, the folded sheet having an integral interlocking resealable fastener adjacent said open end, a second interlocking resealable fastener affixed to said flange, and a backing sheet fixed both to said second interlocking resealable fastener and to said first pocket, thereby to form a second pocket.

* * * * *